US009867457B2

(12) United States Patent
Albers

(10) Patent No.: US 9,867,457 B2
(45) Date of Patent: Jan. 16, 2018

(54) BRUSH CLEANING CUP

(71) Applicant: Luft Industrie Inc., Oakland, CA (US)

(72) Inventor: Oliver Albers, Oakland, CA (US)

(73) Assignee: Luft Industrie, Inc., Oakland, CA (US)

( * ) Notice: Subject to any disclaimer, the term of this patent is extended or adjusted under 35 U.S.C. 154(b) by 0 days.

(21) Appl. No.: 14/796,616

(22) Filed: Jul. 10, 2015

(65) Prior Publication Data

US 2017/0007014 A1 Jan. 12, 2017

(51) Int. Cl.
*A46B 17/06* (2006.01)
*B44D 3/12* (2006.01)

(52) U.S. Cl.
CPC ..... *A46B 17/06* (2013.01); *B44D 3/125* (2013.01); *B44D 3/128* (2013.01); *A46B 2200/1046* (2013.01)

(58) Field of Classification Search
CPC ..... A46B 17/06; A46B 17/02; B44D 3/006; B44D 3/125; B44D 3/12; B44D 13/128; A47K 5/03; A47K 5/04; A45D 27/18
USPC ..... 15/142, 257.01, 257.05, 257.06; 206/209, 361, 362, 15.2; 220/695, 697; D32/53–54
See application file for complete search history.

(56) References Cited

U.S. PATENT DOCUMENTS 2,263,119 A 11/1941 Cornell
2,270,593 A 1/1942 Kurath et al.
2,832,156 A 4/1958 Johnson
3,393,412 A * 7/1968 Wrbican ..... A46B 15/00 15/1
3,776,371 A * 12/1973 Linger ..... B44D 3/04 206/1.7
5,054,661 A * 10/1991 Hollje ..... B44D 3/12 15/257.05
5,097,967 A 3/1992 Sica
5,687,444 A * 11/1997 Hakker ..... A46B 17/06 15/104.92
D457,995 S * 5/2002 Clark ..... D32/53.1
7,140,061 B2 11/2006 Baker et al.
8,167,164 B2 * 5/2012 Peterson ..... B44D 3/126 15/257.06
D724,897 S 3/2015 Gieske et al.
2004/0173622 A1 * 9/2004 Findleton ..... B44D 3/128 220/695
2005/0252920 A1 * 11/2005 Cumming ..... B44D 3/126 220/570
2007/0235395 A1 10/2007 Mondale et al.
(Continued)

FOREIGN PATENT DOCUMENTS

GB 2261812 A * 6/1993 ..... A46B 17/06
GB 2349329 A * 11/2000 ..... A46B 17/06
WO 2011067677 6/2011

*Primary Examiner* — Laura C Guidotti
(74) *Attorney, Agent, or Firm* — Onello & Mello, LLP

(57) ABSTRACT

A brush cleaning cup includes a bottom and one or more sides forming an internal volume for cleaning brushes, such as makeup or cosmetic brushes. The brush cleaning cup can include a plurality of projections, such as tines and ridges on interior surfaces of the bottom and/or sides to facilitate cleaning. In some forms, the bottom and/or sides may include one or more holes, for draining a cleaning agent, such as water. A brush may be positioned in the cup and rubbed against the projections in the presence of the cleaning agent to remove material therefrom.

8 Claims, 12 Drawing Sheets

(56) References Cited

U.S. PATENT DOCUMENTS

| | | | | |
|---|---|---|---|---|
| 2009/0057500 | A1 | 3/2009 | Burchett et al. | |
| 2009/0255837 | A1* | 10/2009 | Mowe | B44D 3/125<br>206/361 |
| 2014/0096801 | A1 | 4/2014 | McCormick et al. | |
| 2015/0296973 | A1* | 10/2015 | Leiker | A46B 17/06<br>15/104.92 |
| 2016/0113386 | A1* | 4/2016 | Lim | A46B 17/06<br>134/6 |

* cited by examiner

BRUSH CLEANING CUP

FIELD OF INTEREST

The present inventive concepts relate to the field of brush care systems, and, in particular, to an apparatus and method for cleaning a brush.

BACKGROUND

Brushes are used in cosmetics for applying cosmetic products and have various shapes and sizes. As cosmetic brushes are being applied to a user's skin, it is important to take care of the brushes and adequately clean the brushes. Dirty brushes may cause skin irritation or infection and may carry impurities to and from a user's face and the cosmetic product. Proper cleaning of the brush and brush head also helps to keep the structure and integrity of the brush and brush head intact. Improper cleaning, or no cleaning, of the brush and brush head can cause damage to the brush and bristles.

BRIEF SUMMARY

In accordance with aspects of the present inventive concepts, there is provided a brush cleaning cup, comprising: a bottom; one or more sides extending from the bottom to form an internal volume; and one or more projections extending into the internal volume from an interior surface of the bottom and/or the one or more sides.

In some embodiments, the one or more projections includes a plurality of tines extending from an interior surface of the bottom.

In some embodiments, the one or more projections includes a plurality of ridges extending from an interior surface of the one or more sides.

In some embodiments, the sides form a rim distal from the bottom and the rim includes at least one depression.

In some embodiments, the rim includes two depressions that form a brush cradle.

In some embodiments, the brush cleaning cup further comprises at least one drain hole formed in the bottom, the one or more sides, or both.

In some embodiments, one or more drain hole is formed in the bottom.

In some embodiments, one or more drain hole is formed in the one or more sides.

In some embodiments, the bottom and the one or more sides are made from a durable, waterproof material chosen from a group comprising silicone, rubber, and plastic.

In accordance with another aspect of the present inventive concepts, there is provided a brush cleaning cup, comprising: a bottom; one or more sides extending from the bottom to form an internal volume; and a plurality of tines extending from an interior surface of the bottom.

In some embodiments, brush cleaning cup further comprises a plurality of ridges extending from an interior surface of the one or more sides.

In some embodiments, the sides form a rim distal from the bottom and the rim includes at least one depression.

In some embodiments, the rim includes two depressions that form a brush cradle.

In some embodiments, the brush cleaning cup further comprises at least one drain hole formed in at least one of the bottom and the one or more sides.

In some embodiments, one or more drain hole is formed in the bottom.

In accordance with another aspect of the present inventive concepts, there is provided a brush cleaning cup, comprising: a bottom; one or more sides extending from the bottom to form an internal volume; a plurality of ridges extending from an interior surface of the one or more sides; and a plurality of tines extending from an interior surface of the bottom.

In some embodiments, the sides form a rim, distal from the bottom and the rim includes at least one depression.

In some embodiments, the rim includes two depressions that form a brush cradle.

In some embodiments, the brush cleaning cup further comprises at least one drain hole formed in at least one of the bottom and the one or more sides.

In some embodiments, one or more drain hole is formed in the bottom.

In some embodiments, one or more drain hole is formed in the one or more sides.

BRIEF DESCRIPTION OF THE DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention.

DETAILED DESCRIPTION

Various exemplary embodiments will be described herein with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Figure 2:
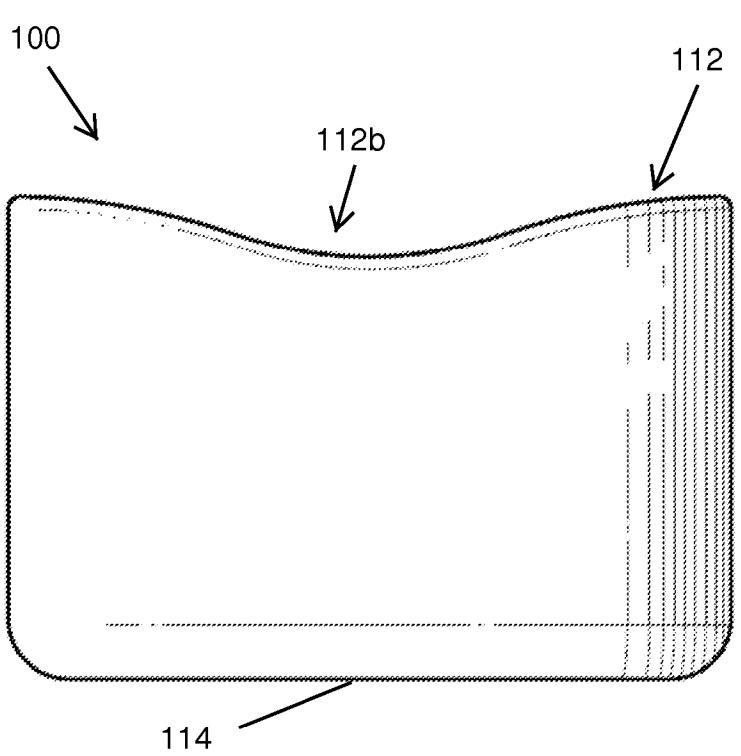
FIG. 2 is a rear view of the brush cleaning cup of FIG. 1.
Figure 1:
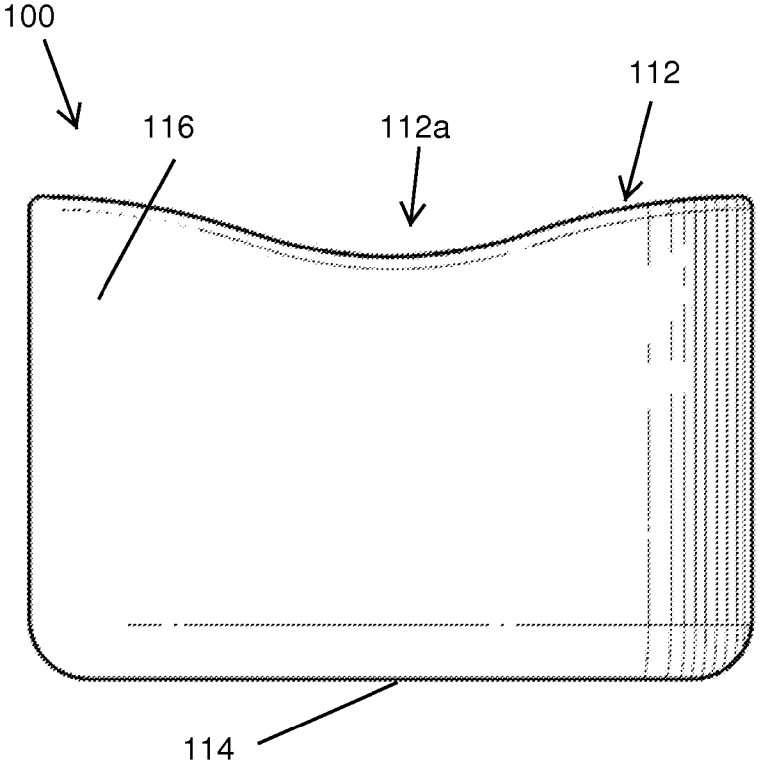
FIG. 1 is a front view of a first embodiment of a brush cleaning cup, in accordance with aspects of the present inventive concepts.
Figure 4:
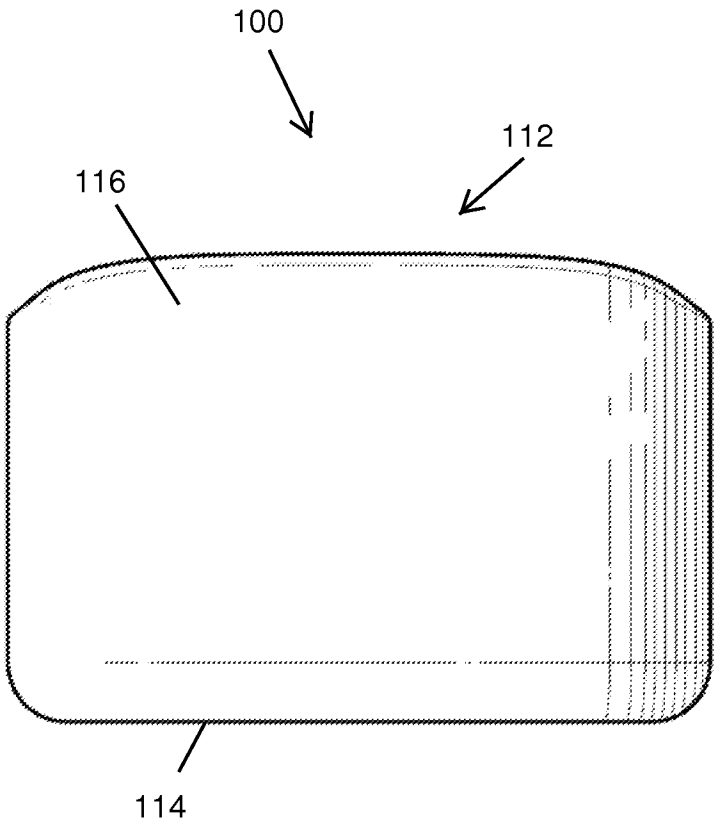
FIG. 4 is a right side view of the brush cleaning cup of FIG. 1.
Figure 3:
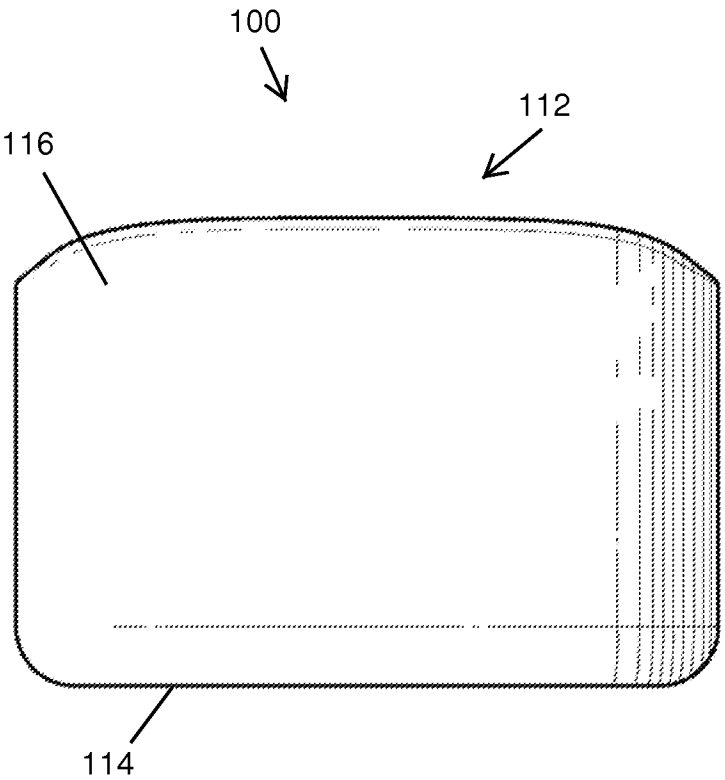
FIG. 3 is a left side view of the brush cleaning cup of FIG. 1.
Figure 6:
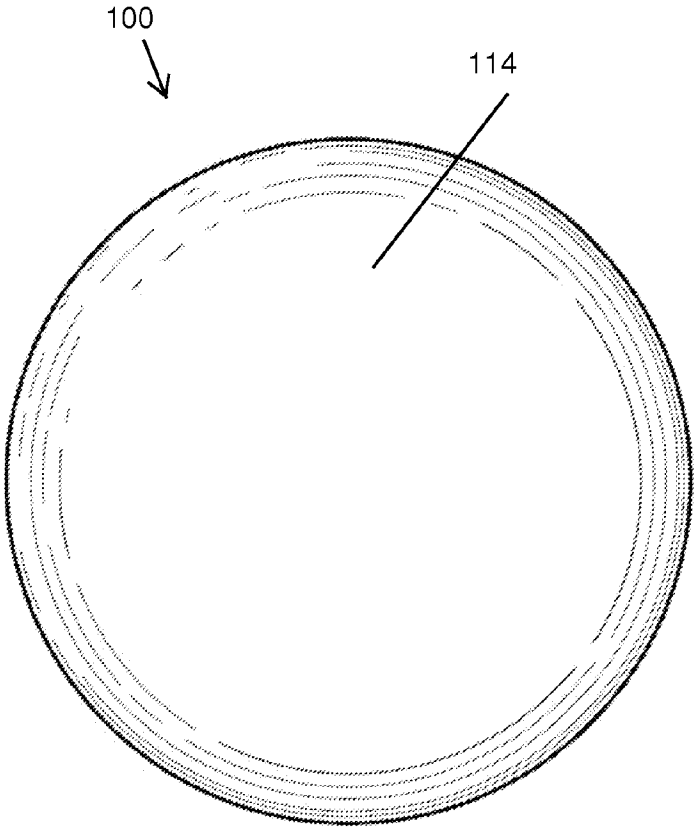
FIG. 6 is a bottom view of the brush cleaning cup of FIG. 1.
Figure 5:
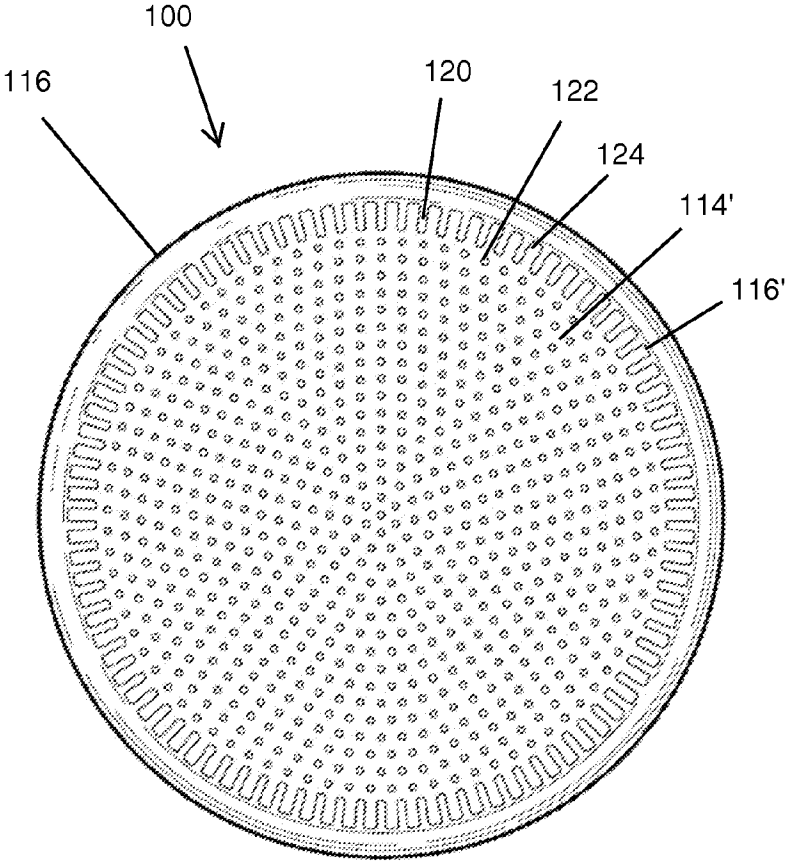
FIG. 5 is a top view of the brush cleaning cup of FIG. 1.
Figure 7:
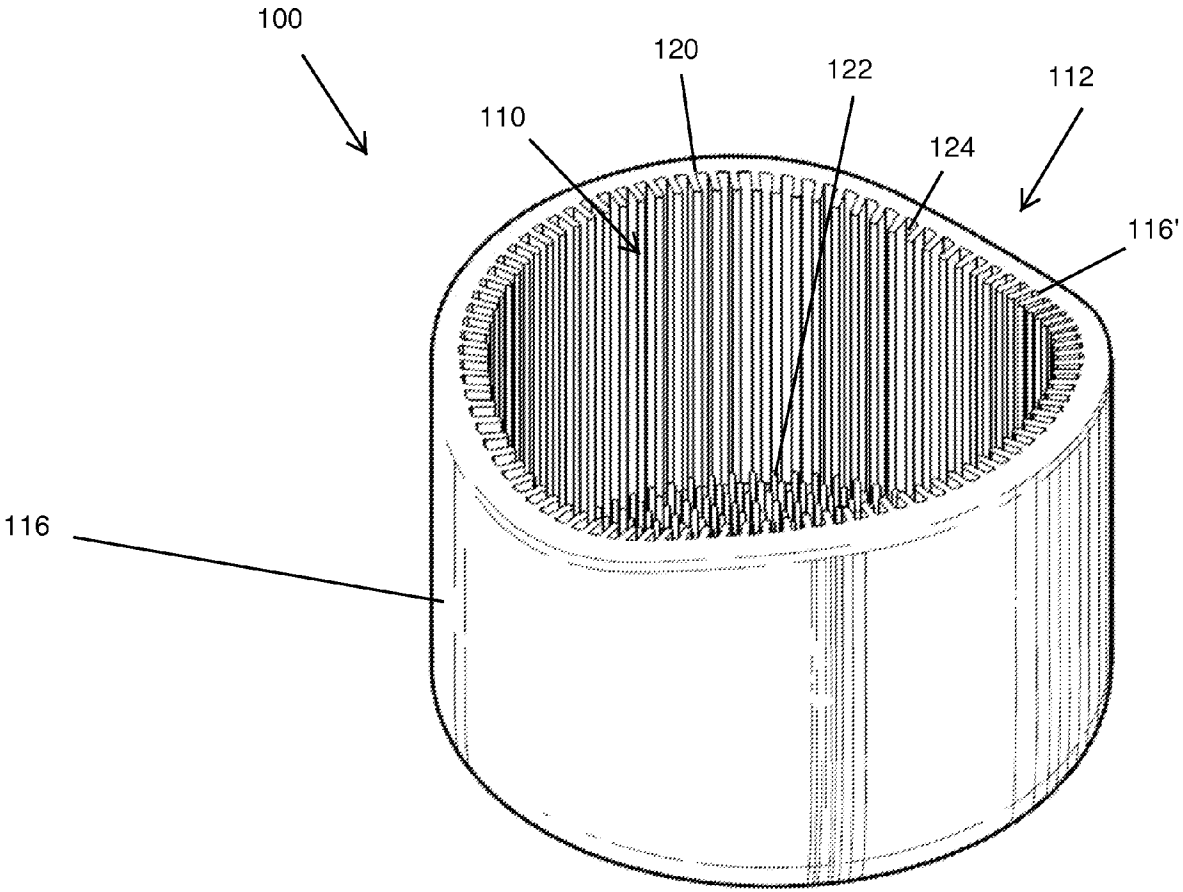
FIG. 7 is a perspective view of the brush cleaning cup of FIG. 1.
Figure 8:
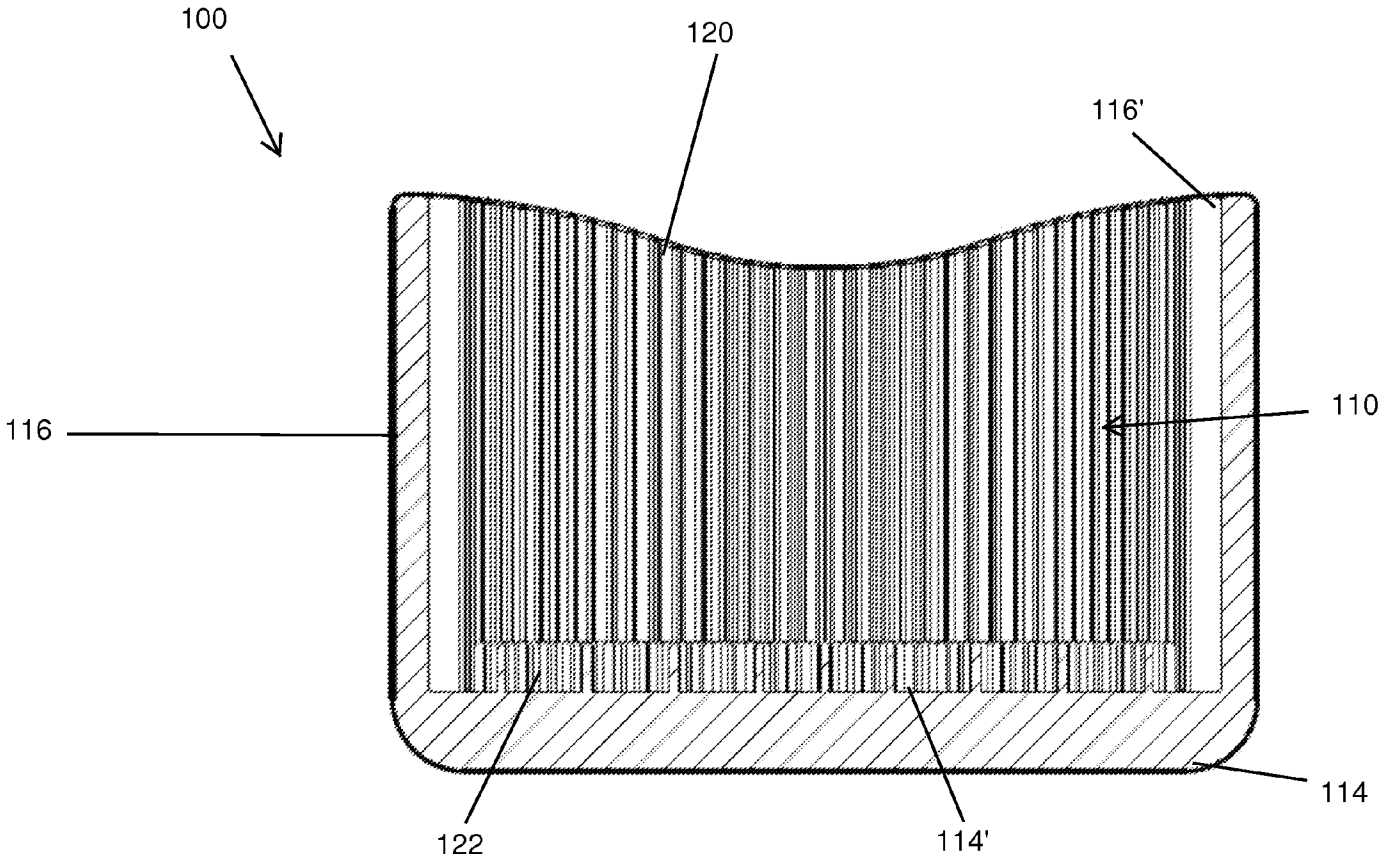
FIG. 8 is a cross-sectional view of the brush cleaning cup of FIG. 1.

FIG. 1 is a front view of a first embodiment of a brush cleaning cup 100, in accordance with aspects of the present inventive concepts. FIG. 2 is a rear view of the brush cleaning cup 100 of FIG. 1. FIG. 3 is a left side view of the brush cleaning cup 100 of FIG. 1. FIG. 4 is a right side view of the brush cleaning cup 100 of FIG. 1. FIG. 5 is a top view of the brush cleaning cup 100 of FIG. 1. FIG. 6 is a bottom view of the brush cleaning cup 100 of FIG. 1. FIG. 7 is a perspective view of the brush cleaning cup 100 of FIG. 1. FIG. 8 is a cross-sectional view of the brush cleaning cup 100 of FIG. 1.

As used herein, the term "brush" means a handheld implement having an elongate handle and a head configured to deliver and apply a liquid or powder substance or material to a surface. The head generally is considered to be formed from a plurality of bristles, whether synthetic or natural, bound together to one end of the handle. However, a brush head could alternatively be formed of a sponge or pad. While the cleaning cup discussed herein is generally described with respect to cleaning bristles, it may also be useful for cleaning a brush with a head formed of a pad, sponge, or the like.

In various embodiments, the brush cleaning cup 100 may be used to clean cosmetic (or makeup) brushes. However, the brush cleaning cup is not necessarily limited to cosmetic brushes in its utility. As examples, the brush cleaning cup could additionally, or alternatively, be used to clean paint brushes (e.g., artists brushes), cooking brushes (e.g., a basting brush or a pastry brush), or the like.

The brush cleaning cup 100 may be arranged and configured as a container that can hold a liquid without leaking. In the figures, brush cleaning cup 100 is shown as an open top container. Optionally, a cover or cap (not shown) could be included to at least partially cover the opening.

The brush cleaning cup 100 is of a sufficient size, such as depth, width, and height, to accommodate containment of a cleaning liquid in the bottom of the cup 100, such as water, soap and water, or other cleaning agents or solutions. The brush cleaning cup 100 is also sized to accommodate dipping of at least the bristles of a brush, and optionally at least a portion of the ferrule that attaches the bristles to a brush handle. Many makeup brushes and artists paint brushes, as examples, vary in sizes. To accommodate a brush of a particular size, interior dimensions of the brush cleaning cup 100 are preferably larger in depth and width than is such brush.

As is shown in FIGS. 1-8, the brush cleaning cup 100 may include a bottom 114 and sides 116 extending upwardly from the bottom 114, which form an internal volume 110 of the cup, e.g., see FIG. 7. In the illustrated embodiment, the sides 116 extend in a substantially vertical direction with respect to the bottom 114. In other embodiments, however, one or more portion of the sides 116 could extend at an angle with respect to the bottom 114, which is substantially flat in the illustrated embodiment.

To facilitate bristle cleaning, one or more protrusions are provided that extend from at least one interior surface of the bottom 114, sides 116, or both. The protrusions can take a variety of forms. The form of the protrusions can be, but need not be, the same on the bottom and the sides. In some embodiments, the sides can have more than one type of protrusion, the bottom can have more than one type of protrusion, or both can have more than one type of protrusion. In still other embodiments, the bottom can have one or more type of protrusion and the sides can have a different one or more type of protrusion. As examples, such protrusions can take the form of tines (or fingers), ridges, bumps, knobs, or any number of shapes projecting from interior surfaces of the sides and/or bottom.

In some embodiments, the brush cleaning cup can include only one of the tines 122 and the ridges 120. In the illustrated embodiment, the brush cleaning cup 100 includes a plurality of small tines (or fingers) 122 extending from an interior bottom surface 114' of the bottom 114 and a plurality of small ridges 120 extending from interior side surfaces 116' of the sides 116—as different types of protrusions.

In this embodiment, the tines 122 extend in the substantially vertical direction from the interior bottom surface 114' of the brush cleaning cup 100. That is, in the illustrated embodiment, the tines 122 extend in a direction substantially perpendicular to the bottom interior surface 114'. The tines 122 are spaced apart from each other along the bottom interior surface 114' of the cup. The distance between the tines may be greater than or about equal to a width of a tine in some, but not all, embodiments, as shown in the example of FIG. 5. The height of the tines can be the same in some, but not all, embodiments, as shown in FIG. 8 for example.

In this embodiment, the ridges 120 extend from the interior side surfaces 116' of the brush cleaning cup 100 and are vertically oriented, i.e., lengthwise in a vertical direction. Here, the ridges also extend radially from the sides 116 toward a center of the cup 100. The ridges are spaced apart from each other along the interior side surface 116'. A gap between the ridges can be greater than or about equal to a width of a ridge in some, but not all, embodiments, as shown in the example FIG. 5. A depth of the ridges, i.e., the distance from the interior side surface 116' to a distal end of a ridge, can be the same in some, but not all, embodiments, as shown in the example of FIG. 5.

In FIGS. 1-8, the brush cleaning cup 100 is shown with tines 122 in the bottom and vertical ridges 120 on the sides 16. In other embodiments, different types of protrusions can be used. For example, ridges could be on the bottom and/or tines could be on the sides. Lateral ridges could be provided in addition to, in or place of, the vertical ridges and/or tines.

As is shown in FIGS. 1-4, 7, and 8, an upper rim 112 of the brush cleaning cup 100 can optionally be formed to have at least one recess, indentation, notch, or depression. In the illustrated embodiment, the brush cleaning cup 100 includes a plurality of depressions. Furthermore, the plurality of depressions takes the form two curved depressions 112*a*, 112*b*. However, the present inventive concepts are not limited thereto. In some embodiments, the upper rim 112 of the brush cleaning cup 100 may be substantially level, i.e., with no depressions.

Since the ridges 120 extend from about the bottom 114 to the rim 112, heights of the ridges are not all the same. In this embodiment, the ridges 120 are shorter in the areas of the depressions 112*a*, 112*b*, due to the non-uniform height of the sides 116. However, in other embodiments, the heights of ridges 120 need not extend from the bottom 114 or all the way to the rim 112.

In the illustrated embodiment, the depressions 112*a*, 112*b* are on opposite sides of the brush cleaning cup 100. As such, the depressions 112*a*, 112*b* are arranged and structured to cradle one or more brushes (See FIG. 10). That is, one end of a brush can rest in depression 112*a* and another end of the brush can rest in depression 112*b*, with an intermediate portion of the brush handle spanning the space in between.

A single depression, e.g., depression 112*a* or depression 112*h*, could be used as a rest to maintain a brush having its bristle end in the brush cleaning cup 100 and its handle extending out of the cup. In such embodiments, only one depression could be included.

The brush cleaning cup 100 may include or be made from silicone, plastic, rubber, resin, wood, glass, ceramic, metal, or other material. In a preferred from, the brush cleaning cup 100 is made from a molded silicone, rubber, or plastic.

A brush cleaning cup according to aspects of the inventive concepts could be structured in any one of a variety of shapes, for example, circular, square, rectangular, triangular, hexagonal, octagonal, decagonal, and so on, heart-shaped, or the like. The illustrated embodiment in FIGS. 1-8 is round, when viewed from the top and bottom.

A method of brush cleaning can be accomplished with a brush cleaning cup in accordance with the inventive concepts. In such a method, a cleaning agent, such as water, soap, liquid cleaner, degreaser, or cleaning solution, is added to the internal volume 110 of the brush cleaning cup 100. A brush head, such as a bristle end of a brush, having removable material thereon, such as paint or makeup or other cosmetics, is placed in the cleaning agent within the brush cleaning cup. The bristles are rubbed against the tines 122 and/or ridges 120. The agitation from the bristles rubbing against tines 122 causes the tines to work themselves between the bristles. This action separates the bristles to loosen the material and allows the cleaning agent to flow through and remove material from between the bristles, even material beneath the surface of the otherwise compact bristles. The ridges 120 could also have this or a similar effect, but are also useful in helping to wring the cleaning agent and material from the bristles, when the bristles are pressed or rubbed against the ridges 120. Channels 124 formed between the ridges 120 provide escape conduits for cleaning agent and material wrung from the brush. The effect of the foregoing steps removes materials such as cosmetics, paint, dirt, and the like from the brush.

The tines 122 and ridges 120 allow for gentle agitation of the brush bristles to more efficiently clean brushes. With bristle head brushes, the tines 122 and ridges 120 open up the bristles to remove cosmetics, paint, dirt and/or other materials. With sponge or pad brushes, the tines 122 are also useful for loosening material on the sponge or pad and the ridges 122 and channels 124 are also effective in wringing out the brush head.

Figure 9B:
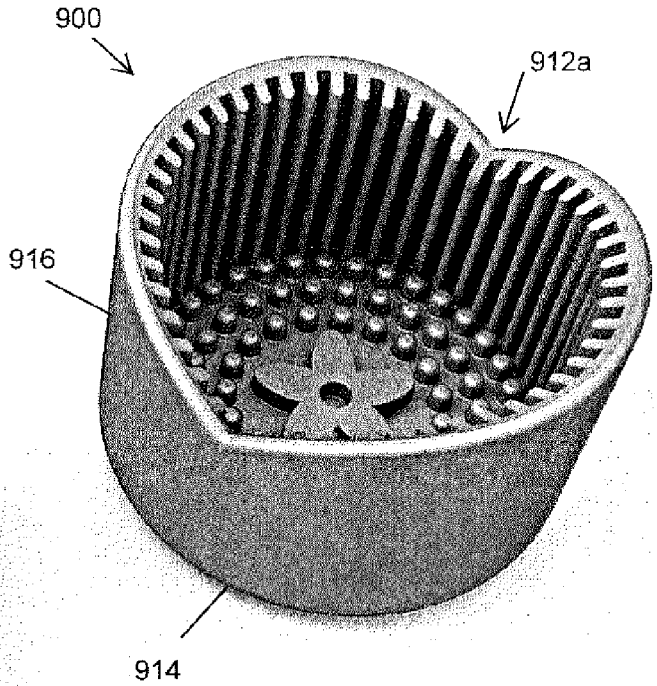
FIGS. 9A and 9B are perspective views of a second embodiment of a brush cleaning cup, in accordance with aspects of the present inventive concepts.
Figure 9A:
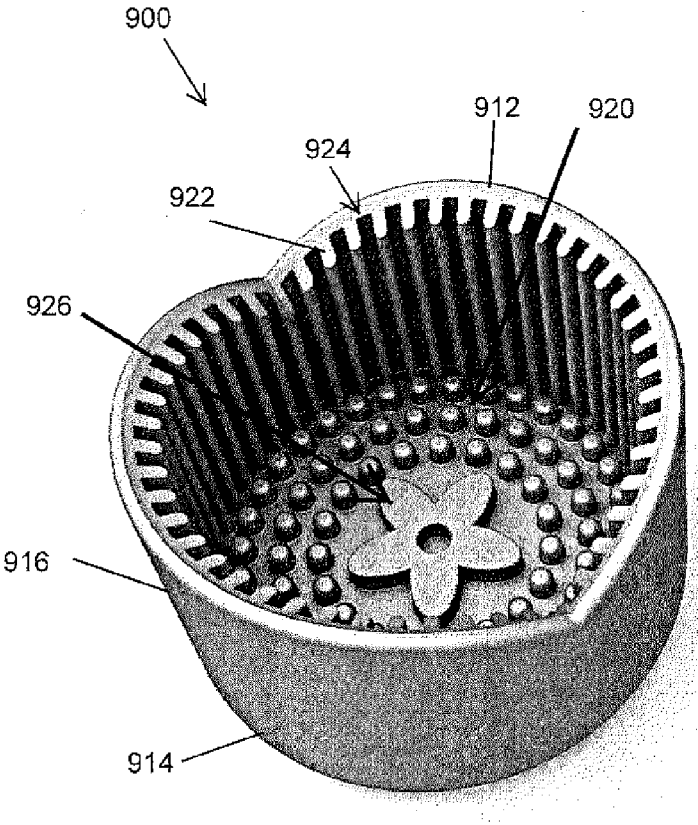
Figure 10:
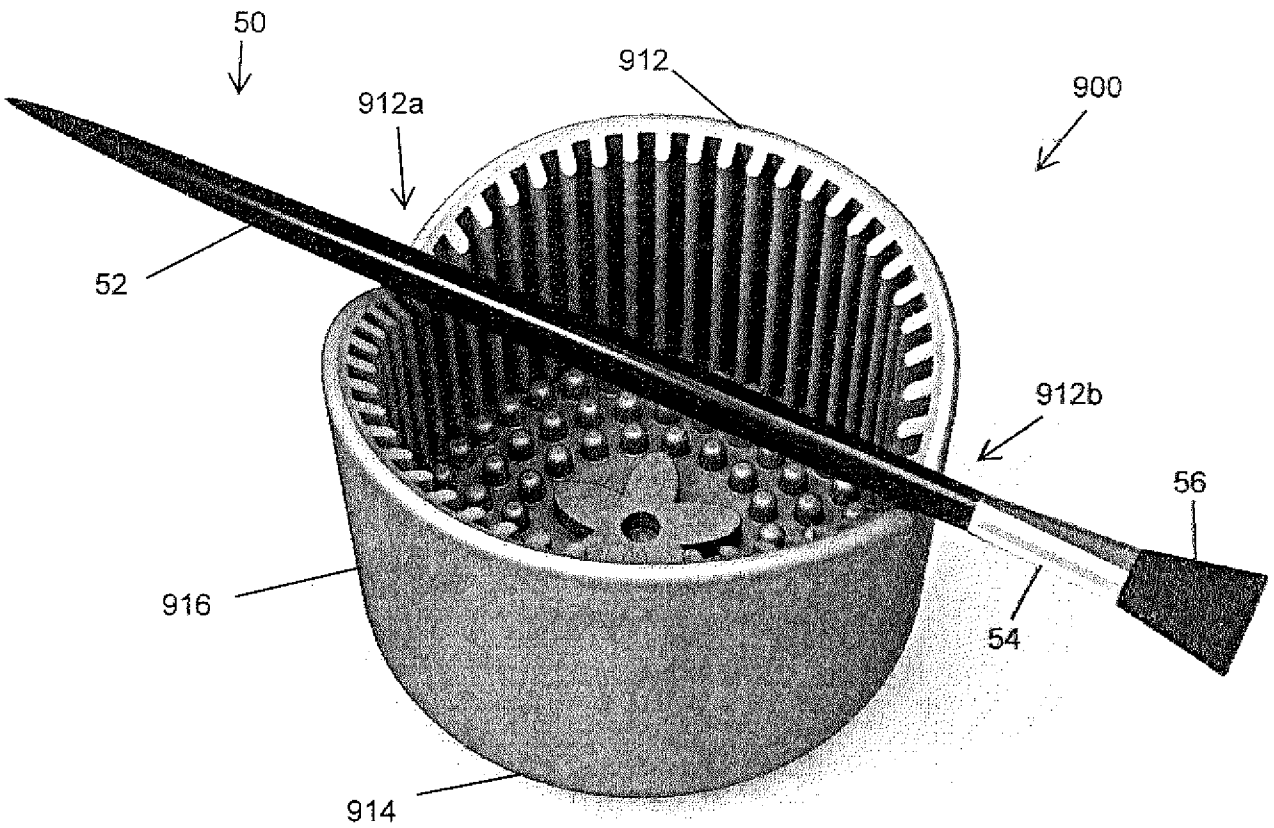
FIG. 10 is a perspective views of the brush cleaning cup of FIGS. 9A and 9B with a brush.

FIGS. 9A, 9B, and 10 are perspective views of a second embodiment of a brush cleaning cup, in accordance with aspects of the present inventive concepts. In this embodiment, a brush cleaning cup 900 is heart-shaped when viewed from a top or a bottom view. Beyond the difference in shape between the brush cleaning cup 900 and the brush cleaning cup 100, several aspects of the brush cleaning cups are substantially the same.

The brush cleaning cup 900 includes a bottom 914 and sides 916. A plurality of vertical ridges 920 extend from one or more interior surface of the sides 916, forming channels 924 by the ridges 920. The ridges 920 and channels 924 are substantially as described above with respect to the brush cleaning cup 100 of FIGS. 1-8, so not described in detail here.

In this embodiment, brush cleaning cup 900 includes tines 922 extending upward from an interior surface of bottom 914, as with the tines of the brush cleaning cup 100 of FIGS. 1-8. In this embodiment, an optional larger element is also formed on the interior surface of the bottom 914. In the illustrated embodiment, the larger element has the form of a flower 926. The flower 926 is disposed at a center of the bottom 914 of the brush cleaning cup 900 and is surrounded by tines/fingers 922. In this embodiment, the brush cleaning cup 900 is formed as a leak-proof container, e.g., with no holes in the bottom. The brush cleaning cup can be made from any number of materials, e.g., silicone, as discussed above.

As is shown in FIGS. 9A, 9B, and 10, an upper rim 914 of the brush cleaning cup 900 can optionally be formed to have at least one recess, indentation, notch, or depression. In the illustrated embodiment, the brush cleaning cup 900 includes two depressions 912*a*, 912*b*. As shown in FIGS. 9A and 9B, the depressions 912*a* and 912*b* can have a "V" form, where the depression has a well-defined vertex. In the illustrated embodiment, the depressions 912*a*, 912*b* are on opposite sides of the brush cleaning cup 900. As such, the depressions 912*a*, 912*b* are arranged and structured to cradle a brush 50. The brush 50 includes a handle 52 and a ferrule 54 coupled to a distal end of the handle 52 that holds a compact collection of bristles 56. In FIG. 10, a proximal end of the brush handle 52 rests in the depression 912*a* and the proximal end of the brush handle rests in the depression 912*b*, with an intermediate portion of the brush handle 52 spanning the space in between. The brush cleaning cup, therefore, can also serve as a brush holder, which may be beneficial for storing or drying one or more brushes.

Figure 12:
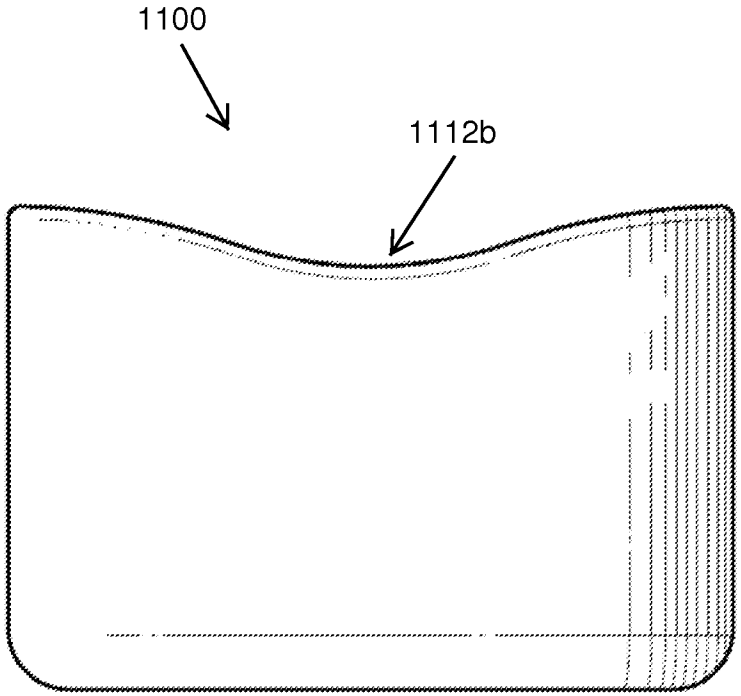
FIG. 12 is a rear view of the brush cleaning cup of FIG. 11.
Figure 11:
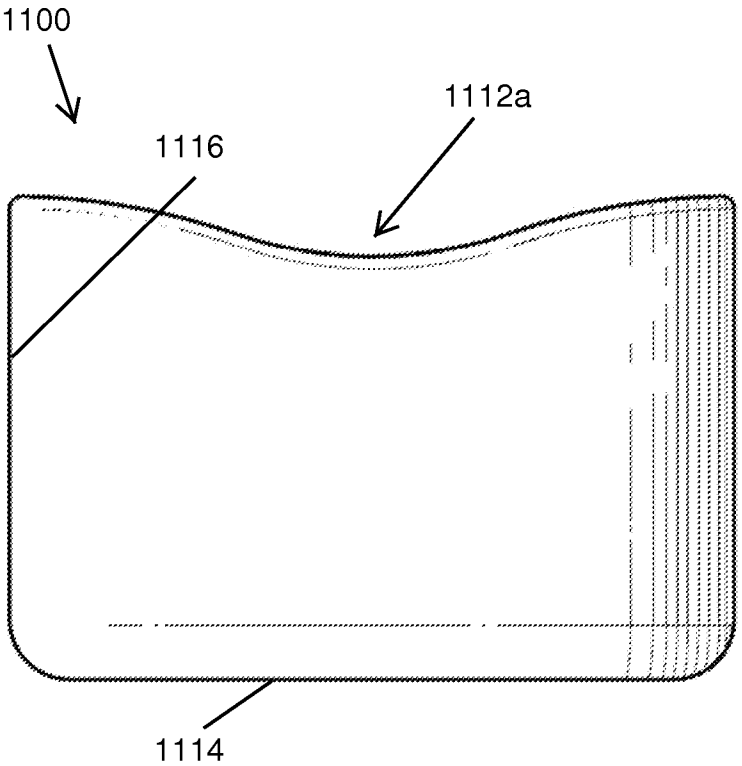
FIG. 11 is a front view of a third embodiment of a brush cleaning cup, in accordance with aspects of the present inventive concepts.
Figure 14:
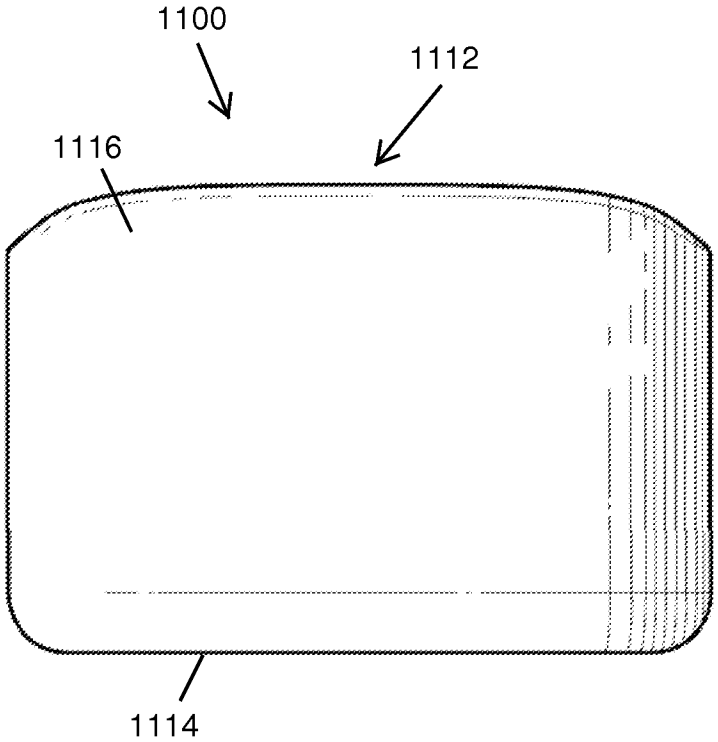
FIG. 14 is a right side view of the brush cleaning cup of FIG. 11.
Figure 13:
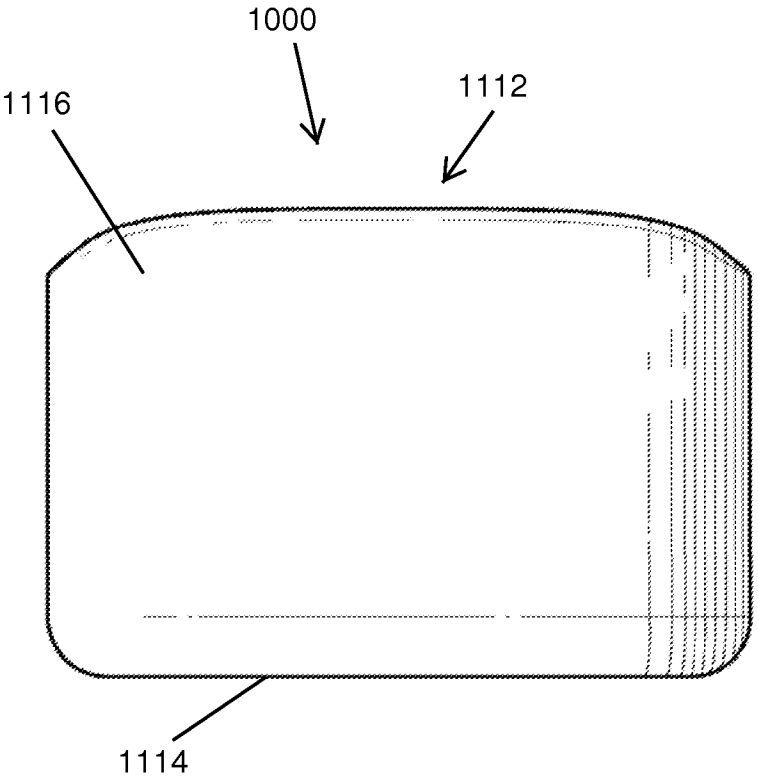
FIG. 13 is a left side view of the brush cleaning cup of FIG. 11.
Figures 15, 16:
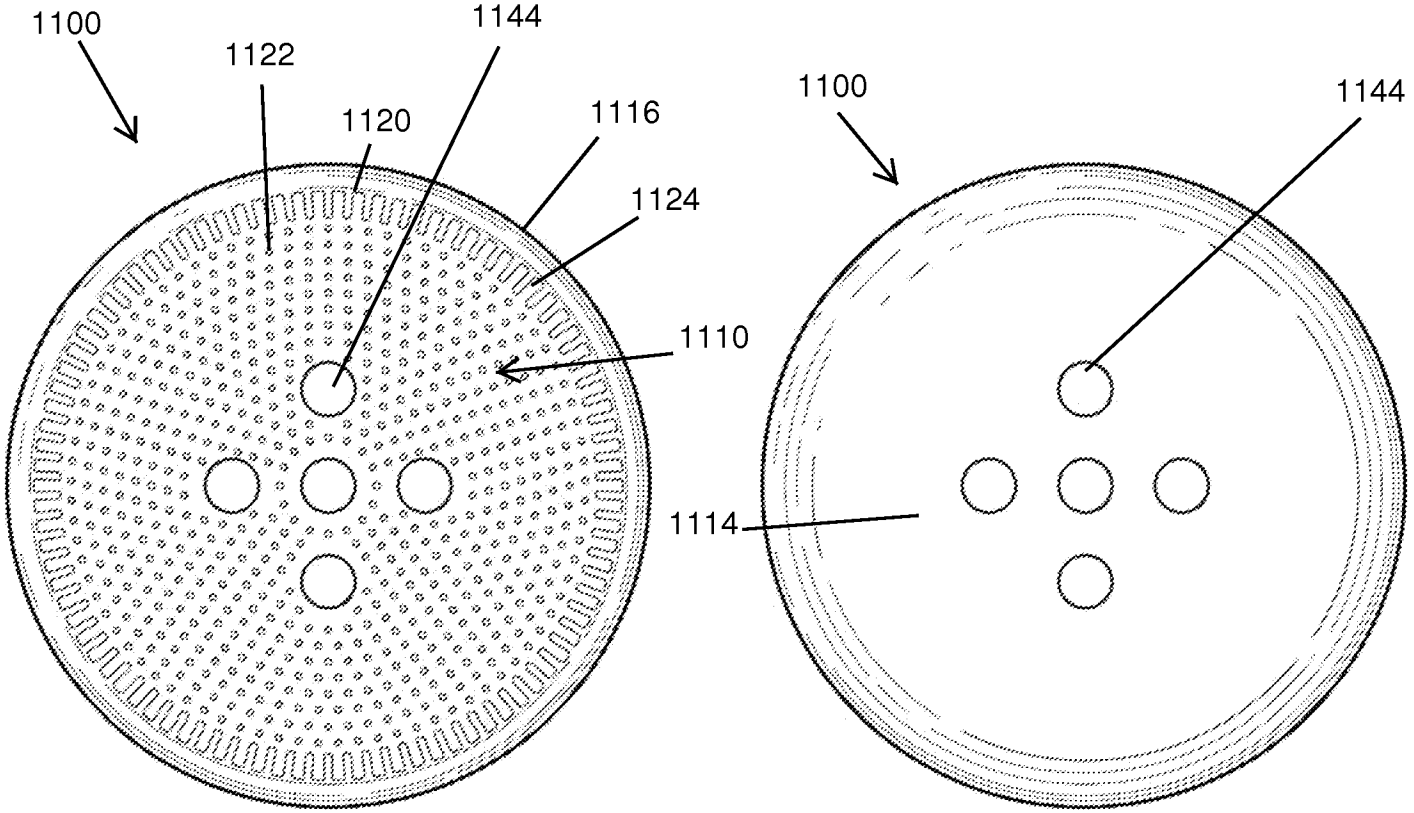
FIG. 15 is a top view of the brush cleaning cup of FIG. 11.
FIG. 16 is a bottom view of the brush cleaning cup of FIG. 11.
Figure 17:
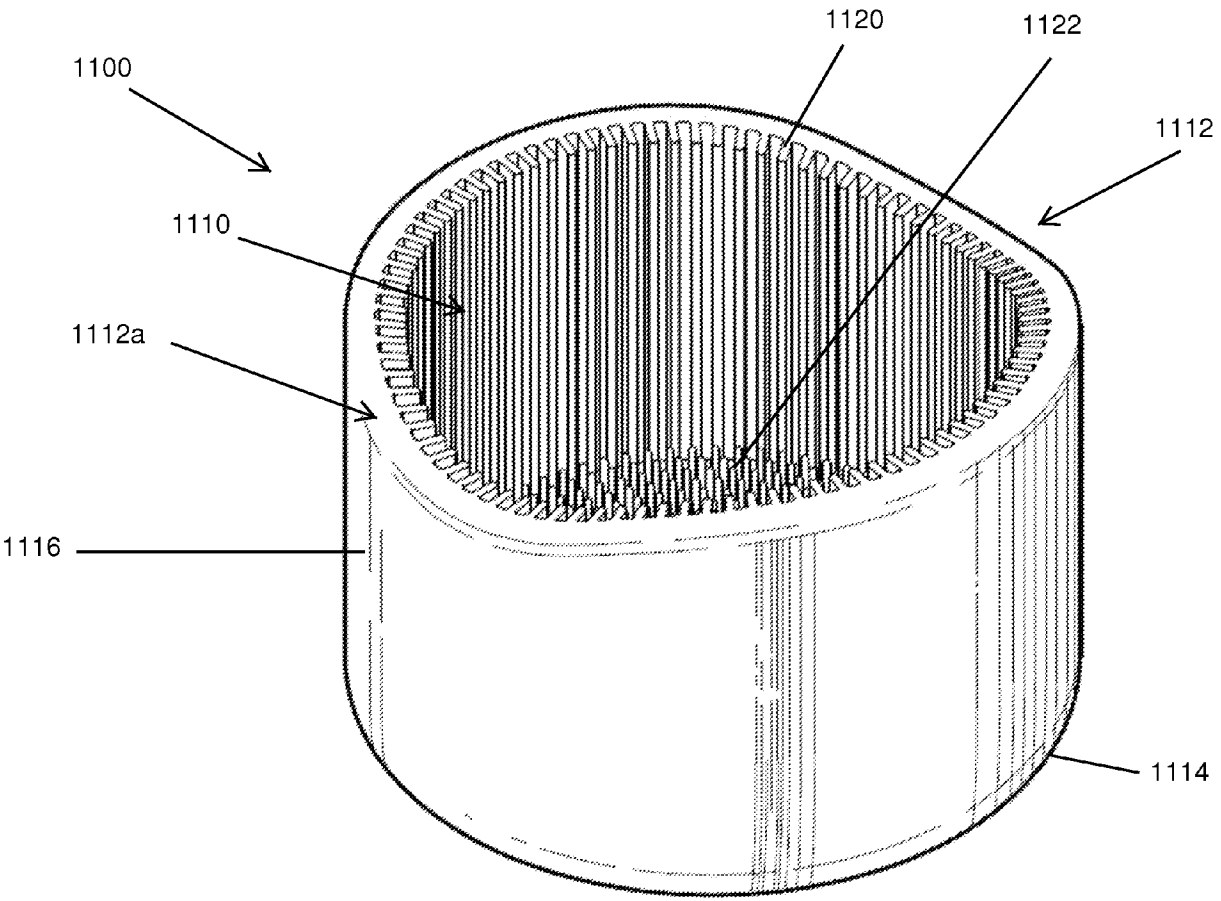
FIG. 17 is a perspective view of the brush cleaning cup of FIG. 11.
Figure 18:
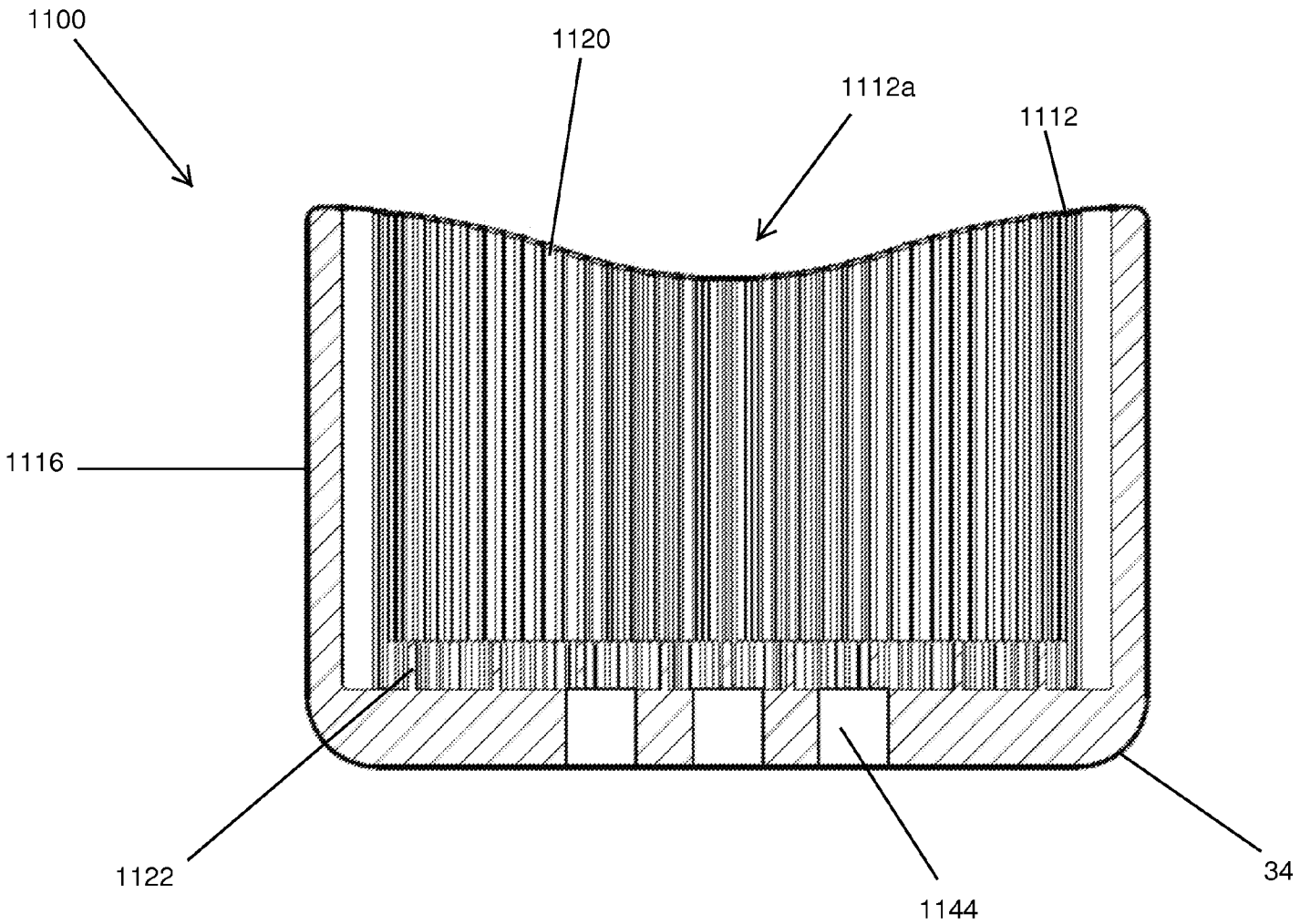
FIG. 18 is a cross-sectional view of the brush cleaning cup of FIG. 11.

FIG. 11 is a front view of a third embodiment of a brush cleaning cup 1100, in accordance with aspects of the present inventive concepts. FIG. 12 is a rear view of the brush cleaning cup 1100 of FIG. 11. FIG. 3 is a left side view of the brush cleaning cup 1100 of FIG. 11. FIG. 14 is a right side view of the brush cleaning cup 1100 of FIG. 11. FIG. 15 is a top view of the brush cleaning cup 1100 of FIG. 11. FIG. 16 is a bottom view of the brush cleaning cup 1100 of FIG. 11. FIG. 17 is a perspective view of the brush cleaning cup 1100 of FIG. 11. FIG. 18 is a cross-sectional view of the brush cleaning cup 1100 of FIG. 11.

In this embodiment, the brush cleaning cup 1100 includes many of the same elements as brush cleaning cup 100 of FIGS. 1-8. The brush cleaning cup 1100 includes a bottom 1114 and sides 1116 defining an internal volume 1110 of the brush cleaning cup. A plurality of vertical ridges 1120 extend from one or more interior surface of the sides 1116, forming channels 1124 by the ridges 1120. The ridges 1120 and channels 1124 are substantially as described above with respect to the brush cleaning cup 100 of FIGS. 1-8. Similarly, the brush cleaning cup can include one or more depressions 1112*a*, 1112*b*, like the one or more depressions 112*a*, 112*b* discussed above. These elements, and some potential variations, are described above with respect to the brush cleaning cup 100, so not described again in detail here.

Unlike the brush cleaning cup 100 of FIGS. 1-8, the brush cleaning cup 1100 is a flow-through or rinsing brush cleaning cup. As a flow-through brush cleaning cup, the brush cleaning cup 1100 includes at least one drain hole formed in its bottom 1114 and/or sidewalls 1116. In FIGS. 15, 16, and 18, a five drain holes 1144 are formed in bottom 1114 of brush cleaning cup 1100. In other embodiments, the plurality of drain holes 1144 may include more or less drain holes. And in still other embodiments, one or more drain holes could additionally or alternatively be formed in the sides 1116 of the cup 1100.

The drain holes enable a user to rinse out any residual material from a brush (e.g., brush 50), such as cosmetics, dirt, paint, brush cleaner or the like. A user can clean a brush by rubbing the brush head (e.g., bristles 56) against the tines 1122 and the ridges 1120 as a cleaning agent, e.g., water, is run through the internal volume 1110 of the cup 1100 and out of the holes. In such a manner, the brush can be rinsed until the cleaning agent runs clear through the drain hole(s). The brush cleaning cup 1100 can be cleaned in the same manner, by running a cleaning agent through the internal volume 1110 and out of the holes 1144.

While the present inventive concepts have been particularly shown and described above with reference to exemplary embodiments thereof, it will be understood by those of ordinary skill in the art, that various changes in form and detail can be made without departing from the spirit and scope of the present inventive concepts.

What is claimed is:

1. A brush cleaning cup, comprising:

a bottom;

one or more sides extending from the bottom to form an internal volume to form a rim distal from the bottom;

a plurality of ridges extending radially from an interior surface of the one or more sides toward a center of the cup; and a plurality of tines extending from an interior surface of the bottom, wherein the plurality of ridges are spaced apart from each other along the one or more sides forming the internal volume, and wherein one or more of the plurality of ridges extends from the bottom to the rim.

2. The brush cleaning cup of claim 1, wherein the plurality of ridges surround the internal volume.

3. The brush cleaning cup of claim 1, wherein the bottom and the one or more sides are made from a durable, waterproof material chosen from a group comprising silicone, rubber, and plastic.

4. The brush cleaning cup of claim 1, wherein the rim includes at least one depression.

5. The brush cleaning cup of claim 4, wherein the rim includes two depressions on opposite sides of the brush cleaning cup that form a brush cradle configured to support a brush spanning the space between the two depressions.

6. The brush cleaning cup of claim 1, further comprising at least one drain hole formed in at least one of the bottom and the one or more sides.

7. The brush cleaning cup of claim 6, wherein one or more drain hole is formed in the one or more sides.

8. The brush cleaning cup of claim 6, wherein one or more drain hole is formed in the bottom.

* * * * *